US006902289B1

(12) United States Patent
Smith

(10) Patent No.: US 6,902,289 B1
(45) Date of Patent: Jun. 7, 2005

(54) ILLUMINATED HAND COVER ASSEMBLY

(75) Inventor: Paul N. Smith, Lakewood, WA (US)

(73) Assignee: 4th Day Enterprises, L.L.C., Lakewood, WA (US)

( * ) Notice: Subject to any disclaimer, the term of this patent is extended or adjusted under 35 U.S.C. 154(b) by 85 days.

(21) Appl. No.: 10/455,100

(22) Filed: Jun. 4, 2003

(51) Int. Cl.[7] ..... F21L 15/08

(52) U.S. Cl. ..... 362/103; 362/8; 362/804; 362/570

(58) Field of Search ..... 362/103, 104, 362/8, 570, 804; 606/86

(56) References Cited

U.S. PATENT DOCUMENTS

| | | | | |
|---|---|---|---|---|
| 455,972 | A | 7/1891 | Oudin et al. | |
| 914,975 | A | 3/1909 | Radley | |
| 1,173,269 | A | 2/1916 | Heidemann | |
| 1,532,493 | A | 4/1925 | Ivie | |
| 1,553,860 | A | 9/1925 | Hopper | |
| 1,754,570 | A * | 4/1930 | Pickett | 362/104 |
| 1,769,241 | A | 7/1930 | Stephani | |
| 2,024,281 | A | 12/1935 | Gaskin | |
| 3,112,889 | A | 12/1963 | Marmo et al. | |
| 3,638,011 | A | 1/1972 | Bain et al. | |
| 3,811,684 | A | 5/1974 | Tredway, Sr. | |
| 4,417,299 | A | 11/1983 | Rupp | |
| 4,422,131 | A | 12/1983 | Clanton et al. | |
| 4,425,600 | A | 1/1984 | Barnhart | |
| 4,459,645 | A | 7/1984 | Glatter | |
| 4,521,832 | A | 6/1985 | Barbour | |
| 4,580,196 | A | 4/1986 | Task | |
| 4,788,631 | A | 11/1988 | Fuller | |
| 4,887,194 | A | 12/1989 | Fields | |
| 4,947,291 | A | 8/1990 | McDermott | |
| 4,970,631 | A | 11/1990 | Marshall | |
| 5,031,080 | A | 7/1991 | Aikens et al. | |
| 5,086,378 | A | 2/1992 | Prince | |
| 5,124,892 | A | 6/1992 | Lambert | |
| 5,255,167 | A | 10/1993 | Toussaint et al. | |
| 5,283,722 | A * | 2/1994 | Koenen et al. | 362/570 |
| 5,450,293 | A * | 9/1995 | Hoffman | 362/570 |
| 5,535,105 | A | 7/1996 | Koenen et al. | |
| 5,816,676 | A | 10/1998 | Koenen Myers et al. | |
| 6,270,231 | B1 | 8/2001 | Kerr | |
| 6,529,121 | B2 | 3/2003 | Bush | |
| 6,709,142 | B2 * | 3/2004 | Gyori | 362/554 |
| 2001/0048596 | A1 | 12/2001 | Kerr | |
| 2003/0060831 | A1 * | 3/2003 | Bonutti | 606/86 |

* cited by examiner

*Primary Examiner*—Stephen Husar
*Assistant Examiner*—James W Cranson
(74) *Attorney, Agent, or Firm*—Christensen O'Connor Johnson Kindness PLLC

(57) ABSTRACT

An illuminated hand cover assembly (100) is provided. The assembly includes a hand cover (102) including an index finger portion (112*a*), the index finger portion adapted to cover at least a portion of a user's index finger (132). A first light source (114) having a first light emission area (118) coupled to a lateral side of the index finger portion such that the first light emission area is disposed adjacent a lateral side of a middle phalanx bone (138) of the index finger. The hand cover may include a thumb portion (112*b*) adapted to cover at least a portion of the user's thumb (142). A second light source (116) having a second light emission area (120) may be coupled to the thumb portion such that the second light emission area is disposed adjacent a lateral side of a proximal phalanx bone (148) of the thumb.

52 Claims, 2 Drawing Sheets

ILLUMINATED HAND COVER ASSEMBLY

FIELD OF THE INVENTION

This invention relates to illumination devices and, more particularly, to illumination devices intercoupled with a hand covering.

BACKGROUND OF THE INVENTION

Often a user must grasp or otherwise manipulate an object with the fingers of his or her hand. It is well known that proper illumination of the object to be manipulated is essential, especially in low light environments, so that the user may both locate and properly manipulate the object. This is especially true in "close work" situations, where the user must locate small objects and perform small, intricate movements upon the object. For instance, when healthcare professionals examine or operate upon patients, a brightly illuminated work surface is essential, especially at the fingertips of the healthcare professional's hand. This is also true in the electronic parts assembly field or for pilots when flying at night in cockpits dimmed to improve visibility of objects outside of the cockpit. In the instance of a pilot, the dimmed cockpit makes locating and operating the control switches of the airplane difficult without the use of illumination devices.

Several previously developed hand illumination assemblies have, to some degree, addressed this problem; however, they are not without their problems. Referring to FIG. 1, one such previously developed hand illumination assembly is depicted. The hand illumination assembly 10 includes a glove 12 worn upon the hand (hidden by the glove 12 in FIG. 1) of a user. A light source 16 is mounted to the glove 12 at a location associated with a top surface of an index finger 18 between the second knuckle and the third knuckle 26 of the index finger 18, i.e., upon a middle phalanx bone 20 of the index finger 18 when the glove 12 is worn.

Although the previously developed hand illumination assembly 10 of FIG. 1 does provide light in the vicinity of the hand 14, the hand illumination assembly 10 fails to provide illumination at the distal ends, or fingertips 22 of the user, especially at the palmar surface of the fingertips. More specifically, by mounting the light source 16 on the dorsal surface of the index finger 18, the cone of illumination 24 emitted from the light source is obstructed by the index finger 18, most notably by the third knuckle 26, such that the fingertips of the user are disposed in a shadow. Thus, an object, such as a switch 28, that the user wishes to grasp and/or manipulate, is not illuminated by the light source 16, hampering the ability of the user to locate and operate the switch 28. This shadow effect is most notable when the index finger 18 is bent, such as when the hand 14 is in an anatomic position of function, as depicted in FIG. 1, wherein the finger tip of the opposing thumb 30 is in contact or in proximity to the fingertip of the index finger 18. Further, there is no light source mounted on the opposing thumb 30, further providing to the lack of illumination at the fingertips of the user's hand 14.

Thus, in operation, the user must first locate the object to be manipulated by directing an axis of illumination 32 of the light source 16 upon the object, such as the switch 28, by placing the hand 14 in front of the switch 28. The user then must memorize the location of the switch 28 and move the hand 14 to the memorized location and attempt to grasp the switch 28, which is now in a shadow region, and operate the switch in darkness. This leads to errors, as the user must memorize the location of the switch 28, which is prone to error, and also operate the switch 28 in darkness. Thus, it should be apparent to those skilled in the art, that although previously developed hand illumination assemblies are somewhat effective, they are not without their problems, since they fail to illuminate the object at the instance the fingers actually grasp the object.

Therefore, there exists a need for a hand illumination assembly that directs the axis of illumination of the light source at the fingertips of the user, especially the palmar surface of each fingertip, is reliable, easy to use, easy to manufacture, and meets the performance requirements of the end user.

SUMMARY OF THE INVENTION

In accordance with one embodiment of the present invention, an illuminated hand cover assembly is provided. The illuminated hand cover assembly includes a hand cover including an index finger portion, the index finger portion adapted to cover at least a portion of a user's index finger when the hand cover is donned. A first light source having a first light emission area is coupled to a lateral side of the index finger portion such that the first light emission area is disposed adjacent a lateral side of a phalanx bone of the index finger of the user when the hand cover is donned.

In accordance with another embodiment of the present invention, an illuminated hand cover assembly is provided. The illuminated hand cover assembly includes a hand cover including a thumb portion, the thumb portion adapted to cover at least a portion of a user's thumb when the hand cover is donned. A first light source having a first light emission area is coupled to a lateral side of the thumb portion such that the first light emission area is disposed adjacent a lateral side of a phalanx bone of the thumb of the user when the hand cover is donned.

In accordance with yet another embodiment of the present invention, an illuminated hand cover assembly is provided. The illuminated hand cover assembly includes a hand cover including a thumb portion, the thumb portion adapted to cover at least a portion of a user's thumb when the hand cover is donned, and an index finger portion adapted to cover at least a portion of the user's index finger when the hand cover is donned. A first light source having a first light emission area is coupled to a lateral side of the thumb portion such that the first light emission area is disposed adjacent a lateral side of a phalanx bone of the thumb of the user when the hand cover is donned. A second light source having a second light emission area is coupled to the index finger portion such that the second light emission area is disposed adjacent a lateral side of a phalanx bone of the index finger of the user when the hand cover is donned.

BRIEF DESCRIPTION OF THE DRAWINGS

The foregoing aspects and many of the attendant advantages of this invention will become more readily appreciated by reference to the following detailed description, when taken in conjunction with the accompanying drawings, wherein.

DETAILED DESCRIPTION OF THE PREFERRED EMBODIMENT

Figure 1:
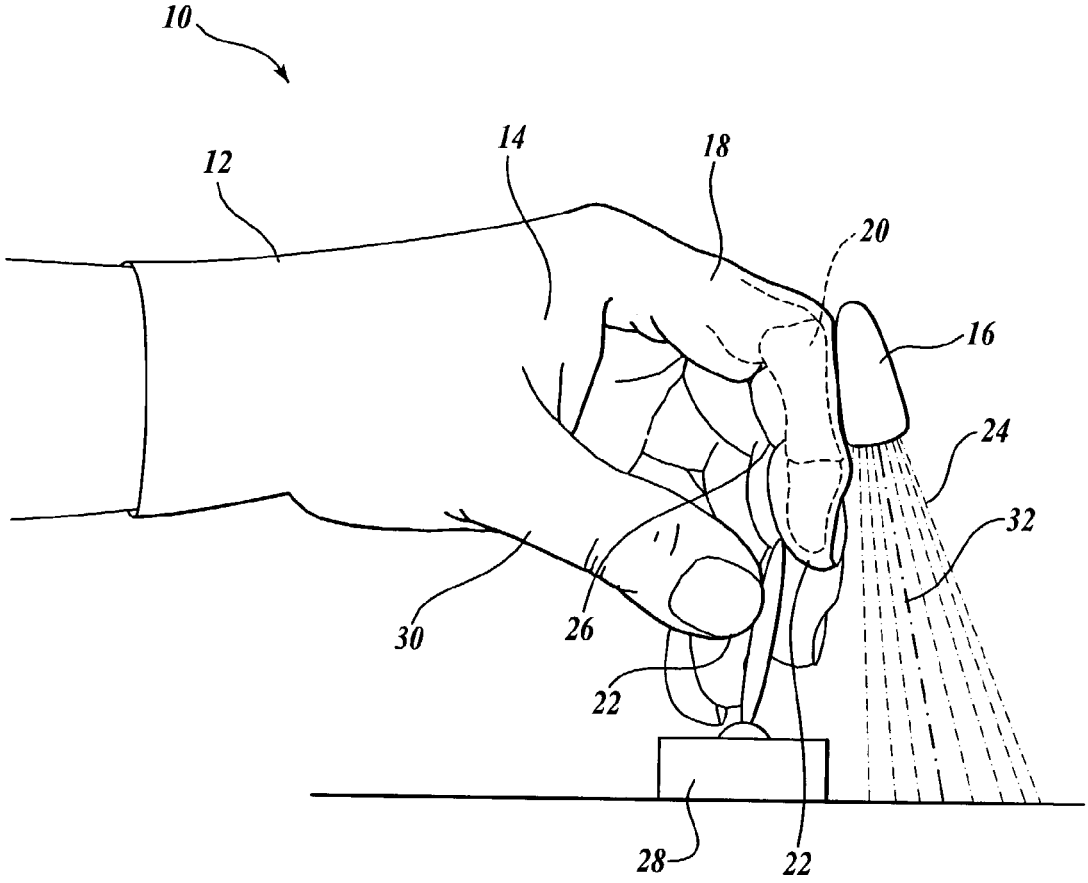
Fig.1. (PRIOR ART)
FIG. 1 is an elevation view of a previously developed hand illumination assembly depicting a light source coupled to a glove and positioned over a dorsal surface of an index finger, wherein a cone of illumination of the light source is shadowed by the index finger, leaving the object to be grasped in darkness.
Figure 2:
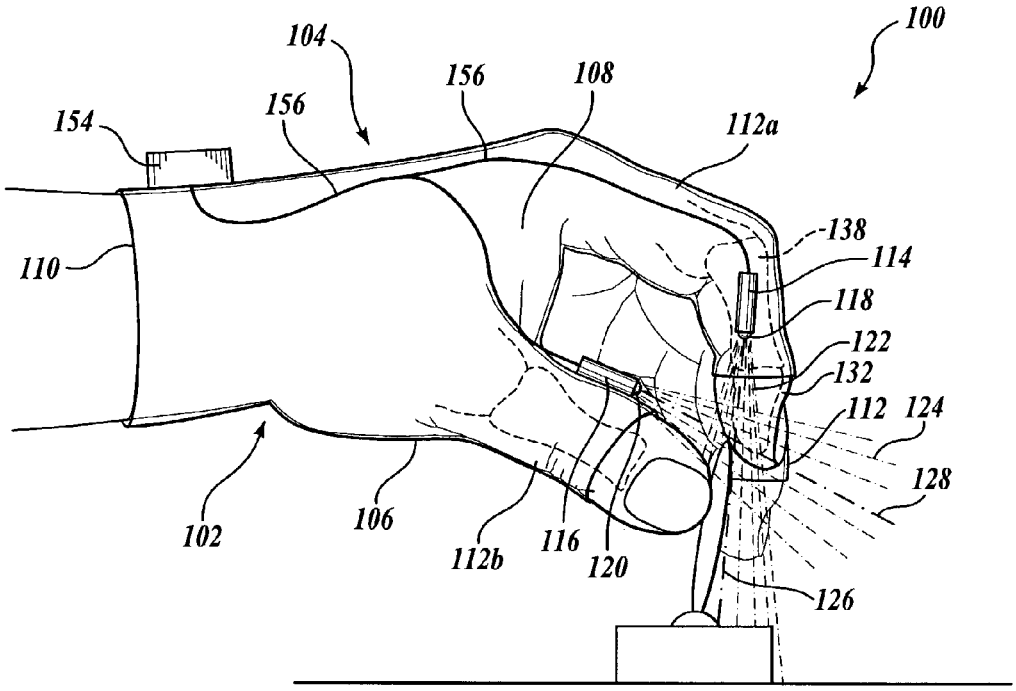
FIG. 2 is an elevation view of one embodiment of an illuminated hand cover assembly formed in accordance with the present invention, depicting a first light source coupled to an index finger portion of a hand cover and a second light source coupled to a thumb portion of the hand cover, wherein a respective axis of illumination of each light source is directed at the palmar surfaces of the fingertips of the index finger and thumb.
Figure 3:
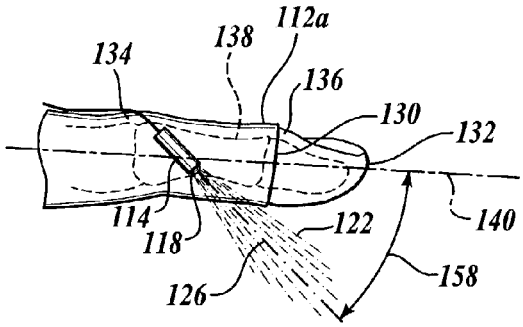
FIG. 3 is an elevation view of the index finger portion of the hand cover and attached first light source depicted in FIG. 2.
Figure 4:
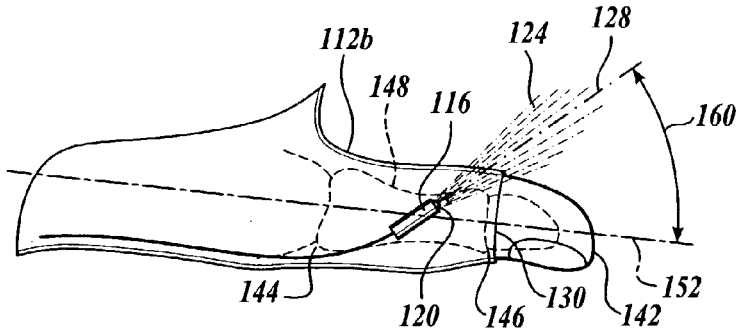
FIG. 4 is an elevation view of the thumb portion of the hand cover and attached second light source depicted in FIG. 2.

FIGS. 2–4 depict one embodiment of an illuminated hand cover assembly 100 formed in accordance with the present invention. The illuminated hand cover assembly 100 includes a hand cover 102 and an illumination system 104. The hand cover 102 is formed by a glove 106 formed to receive a hand 108 of a user. The glove 106 includes a wrist aperture 110 for permitting the insertion of the hand therein. The glove 106 also includes five finger portions 112 for permitting the insertion of each of the fingers of the user's hand 108 therein. The finger portions 112 each include an aperture 130 (best seen in FIG. 3) at a distal end of each finger portion 112 to permit the distal end of each finger to project therethrough. Thus, the distal end of each finger of the user's hand is uncovered to enhance the sensation of touch in the user's fingers. The glove 106 may be made from any suitable material, such as fabric, latex, etc. Preferably, the material is thin to permit a user to easily feel an object touched by the hand.

Although in the illustrated embodiment the hand cover 102 is in the form of a glove 106, it should be apparent to those skilled in the art that the hand cover 102 may take many suitable forms. For instance, the hand cover may be a mitt, a glove that includes portions that cover the fingertips of the fingers, or the hand cover may include solely one or more finger portions 112 which cover one or more fingers without a portion that covers the hand.

The illumination system 104 includes a first light source 114 and a second light source 116. The light sources 114 and 116 may be any suitable light source, such as a light emitting diode (LED) light source, fiber optic light source, incandescent light source, halogen light source, or other light source now known or to be developed. Each light source 114 and 116 includes a light emission area 118 and 120 respectively, such as a lens, aperture, etc., wherein the light generated by the light source 114 and 116 is emitted. The light emission areas 118 and 120 may be displaced a large distance from the light sources 114 and 116, for instance in the case where the light sources 114 and 116 are of the fiber optic type, are displaced by a smaller distance, such as where the light sources 114 and 116 are a halogen light source and the light emission areas 118 and 120 are lenses. The light is emitted from the light emission areas 118 and 120 in a cone of illumination 122 and 124, each centered about an axis of illumination 126 and 128, respectively.

The first and second light sources 114 and 116 and each of the light emission areas 118 and 120 are coupled to the hand cover 102. The light emission areas 118 and 120 may be coupled to an outer surface of the hand cover 102 or to an inner surface of the hand cover 102 and shine through a transparent portion of the hand cover 102, or alternately emit light through an aperture in the hand cover 102. Alternately, the light sources 114 and 116 may be embedded within the material forming the hand cover 102, and either shine through the material of the hand cover 102 or direct light through apertures in the hand cover 102.

In the illustrated embodiment, the light sources 114 and 116 and accompanying light emission areas 118 and 120 are coupled to an outer surface of the hand cover 102. Turning now to FIGS. 2 and 3, the light source 114 and accompanying light emission area 118 may be coupled to an index finger portion 112*a* of the hand cover 102. The index finger portion 112*a*, as the name implies, is adapted to cover the index finger 132 of the user. More specifically, the first light source 114 and accompanying light emission area 118 may be coupled to the index finger portion 112*a* of the hand cover 102 so as to be disposed adjacent a phalanx bone of the index finger 132.

Preferably, the light emission area 118 is disposed on the index finger portion 112*a* such that when the hand cover 102 is donned, the light emission area 118 is disposed between the second knuckle 134 and third knuckle 136, i.e. adjacent a middle phalanx bone 138 of the index finger 118. Preferably, the axis of illumination 126 of the light source 114 is inclined relative to a center axis of the phalanx bone upon which the light emission area 118 is mounted, such as inclined relative to the center axis 140 of the middle phalanx bone 138. Preferably, the axis of illumination 126 is inclined from a center axis of its respective adjacent phalanx bone, such as the center axis 140 of the middle phalanx bone 138, by an angle 158 greater than 0 degrees and less than about 45 degrees, with a preferred value of about 15 degrees. Further, the light source 114 and/or the light emission area 118 may be coupled to a lateral side of the index finger portion 112*a*.

With the light source 114 and emission area 118 coupled to the index finger portion 112*a* as described, the axis of illumination 126 is directed to the palmar surface of the finger tip of the index finger 132 when the hand 108 is in the anatomical position of function as depicted in FIG. 2. Thus, the user can both locate and grasp an object while the object is fully illuminated by the cone of illumination 122 emitted from the light emission area 118.

With reference to the second light source 116, the light source 116 and accompanying light emission area 120 are coupled to a thumb portion 112*b* of the hand cover 102, as best shown in FIG. 4. The thumb portion 112*b*, as the name implies, is adapted to cover the thumb 142 of the user. More specifically, the second light source 116 and accompanying light emission area 120 may be coupled to the thumb portion 112*b* of the hand cover 102 so as to be disposed adjacent a phalanx bone of the thumb 142.

Preferably, the light emission area 120 is disposed on the thumb portion 112*b* such that when the hand cover is donned, the light emission area 120 is disposed between a first knuckle 144 and a second knuckle 146 of the thumb, i.e. adjacent a proximal phalanx bone 148 of the thumb 142. Preferably, an axis of illumination 128 of the light source 116 is inclined relative to a center axis of the phalanx bone upon which the light emission area 120 is mounted, such as inclined relative to a center axis 152 of the proximal phalanx bone 148. Preferably, the axis of illumination 128 is inclined from a center axis of one of the phalanx bones, such as the center axis 152 of the proximal phalanx bone 148, by an angle 160 greater than 0 degrees and less than about 45 degrees, with a preferred value of about 10 degrees. Further, the light source 116 and/or the light emission area 120 are coupled to a lateral side of the thumb portion.

With the light source 116 and emission area 120 coupled to the thumb portion 112*b* as described, the axis of illumination 128 is directed to the palmar surface of the finger tip of the thumb 142 when the hand is in the anatomical position of function as depicted in FIG. 2. Thus, the user can both locate and grasp an object while the object is fully illuminated by the cone of illumination 124 emitted from the light emission area 120.

As shown in FIG. 2, an energy source 154 is coupled in signal communication with the light sources 114 and 116 by a cable assembly 156. The energy source 154 includes a power source, such as batteries. The energy source 154 is in communication with the light sources 114 and 116 to provide energy to power the light sources 114 and 116. The energy source 154 may be coupled to the hand cover 102 as depicted. Alternately, the energy source 154 may be incorporated into the light sources 114 and 116 themselves, or may be located remotely of the hand cover 102, such as upon the body of the user.

Although the illuminated hand cover assembly 100 is depicted as having a light source coupled to both the index finger portion 112*a* and the thumb portion 112*b* of the hand cover 102, it should be apparent that alternate configurations are suitable for use with and within the spirit and scope of the present invention. For instance, the illuminated hand cover assembly 100 may include a single light source coupled to solely the index finger portion 112*a*, or a light source coupled to solely the thumb cover portion 112*b*. Alternately, a light source may be coupled to any one of the five finger portions 112, or all of the finger portions 112, or any combination thereof. Preferably, the light emission areas of the light sources are coupled to a lateral side of the finger portion and inclined relative to the phalanx bone of the finger portion of the hand cover when donned by the user.

While the preferred embodiments of the invention have been illustrated and described, it will be appreciated that various changes can be made therein without departing from the spirit and scope of the invention, as claimed.

What is claimed is:

1. An illuminated hand cover assembly comprising:

(a) a hand cover including an index finger portion, the index finger portion adapted to cover at least a portion of a user's index finger when the hand cover is donned; and (b) a first light source having a first light emission area coupled to a lateral side of the index finger portion such that the first light emission area is disposed adjacent a lateral side of the middle phalanx bone of the index finger of the user when the hand cover is donned.

2. The illuminated hand cover assembly of claim 1, wherein the first light emission area is adapted to emit light about a first axis of illumination, the first axis of illumination inclined relative to a center axis of the middle phalanx bone of the index finger by a first selected incline angle to direct the first axis of illumination toward a palmar surface of a fingertip of the index finger of the user when the hand cover is donned.

3. The illuminated hand cover assembly of claim 1, wherein the first light emission area is adapted to emit light about a first axis of illumination, the first axis of illumination inclined relative to a center axis of the middle phalanx bone of the index finger by a first selected incline angle to direct the first axis of illumination toward a distal end of the index finger of the user when the hand cover is donned.

4. The illuminated hand cover assembly of claim 3, wherein the first selected incline angle is greater than 0 degrees and less than about 45 degrees.

5. The illuminated hand cover assembly of claim 3, wherein the first selected incline angle is greater than about 5 degrees and less than about 30 degrees.

6. The illuminated hand cover assembly of claim 1, wherein the index finger portion includes an aperture at a distal end of the index finger portion to expose a distal end of the index finger of the user when the hand cover is donned by the user.

7. The illuminated hand cover assembly of claim 1, further comprising an energy source coupled to the hand cover, the energy source coupled in communication with the first light source to provide energy to the light source.

8. The illuminated hand cover assembly of claim 1, wherein the hand cover further includes a thumb portion adapted to cover at least a portion of the user's thumb when the hand cover is donned, and further including a second light source having a second light emission area coupled to the thumb portion such that the second light emission area is disposed adjacent a lateral side of a proximal phalanx bone of the thumb of the user when the hand cover is donned.

9. The illuminated hand cover assembly of claim 8, wherein the thumb portion includes an aperture at a distal end of the thumb portion to expose a distal end of the thumb of the user when the hand cover is donned by the user.

10. The illuminated hand cover assembly of claim 8, wherein the second light emission area is adapted to emit light about a second axis of illumination, the second axis of illumination inclined relative to a center axis of the proximal phalanx bone of the thumb by a second selected incline angle to direct the second axis of illumination toward a distal end of the thumb of the user when the hand cover is donned.

11. The illuminated hand cover assembly of claim 10, wherein the second selected incline angle is greater than 0 degrees and less than about 45 degrees.

12. The illuminated hand cover assembly of claim 10, wherein the second selected incline angle is greater than about 5 degrees and less than about 30 degrees.

13. An illuminated hand cover assembly comprising:

(a) a hand cover including a thumb portion, the thumb portion adapted to cover at least a portion of a user's thumb when the hand cover is donned; and (b) a first light source having a first light emission area coupled to a lateral side of the thumb portion such that the first light emission area is disposed adjacent a lateral side of a proximal phalanx bone of the thumb of the user when the hand cover is donned.

14. The illuminated hand cover assembly of claim 13, wherein the first light emission area is adapted to emit light about a first axis of illumination, the first axis of illumination inclined relative to a center axis of the proximal phalanx bone of the thumb by a first selected incline angle to direct the first axis of illumination toward a palmar surface of a fingertip of the thumb of the user when the hand cover is donned.

15. The illuminated hand cover assembly of claim 13, wherein the first light emission area is adapted to emit light about a first axis of illumination, the first axis of illumination inclined relative to a center axis of the proximal phalanx bone of the thumb by a first selected incline angle to direct the first axis of illumination toward a distal end of the thumb of the user when the hand cover is donned.

16. The illuminated hand cover assembly of claim 15, wherein the first selected incline angle is greater than 0 degrees and less than about 45 degrees.

17. The illuminated hand cover assembly of claim 15, wherein the first selected incline angle is greater than about 5 degrees and less than about 30 degrees.

18. The illuminated hand cover assembly of claim 13, wherein the thumb portion includes an aperture at a distal end of the thumb portion to expose a distal end of the thumb of the user when the hand cover is donned by the user.

19. The illuminated hand cover assembly of claim 13, further comprising an energy source coupled to the hand cover, the energy source coupled in communication with the first light source to provide energy to the light source.

20. An illuminated hand cover assembly comprising:

(a) a hand cover including;

(i) a thumb portion, the thumb portion adapted to cover at least a portion of a user's thumb when the hand cover is donned; and (ii) an index finger portion adapted to cover at least a portion of the user's index finger when the hand cover is donned;

(b) a first light source having a first light emission area coupled to a lateral side of the thumb portion such that the first light emission area is disposed adjacent a lateral side of a proximal phalanx bone of the thumb of the user when the hand cover is donned; and (c) a second light source having a second light emission area coupled to the index finger portion such that the second light emission area is disposed adjacent a lateral side of a middle phalanx bone of the index finger of the user when the hand cover is donned.

21. The illuminated hand cover assembly of claim 20, wherein the first light emission area is adapted to emit light about a first axis of illumination, the first axis of illumination inclined relative to a center axis of the proximal phalanx bone of the thumb by a first selected incline angle to direct the first axis of illumination toward a distal end of the thumb of the user when the hand cover is donned, and wherein the second light emission area is adapted to emit light about a second axis of illumination, the second axis of illumination inclined relative to a center axis of the middle phalanx bone of the index finger by a second selected incline angle to direct the second axis of illumination toward a distal end of the index finger of the user when the hand cover is donned.

22. The illuminated hand cover assembly of claim 21, wherein the first and second selected incline angles are each greater than 0 degrees and less than about 45 degrees.

23. The illuminated hand cover assembly of claim 21, wherein the first and second selected incline angles are each greater than about 5 degrees and less than about 30 degrees.

24. The illuminated hand cover assembly of claim 20, wherein the thumb portion includes an aperture at a distal end of the thumb portion to expose a distal end of the thumb of the user when the hand cover is donned by the user.

25. The illuminated hand cover assembly of claim 20, wherein the index finger portion includes an aperture at a distal end of the index finger portion to expose a distal end of the index finger of the user when the hand cover is donned by the user.

26. The illuminated hand cover assembly of claim 20, further comprising an energy source coupled to the hand cover, the energy source coupled in communication with the first light source to provide energy to power the light source.

27. The illuminated hand cover assembly of claim 8, further comprising an energy source coupled to the hand cover, the energy source coupled in communication with the first light source and the second light source to provide energy to power the first and second light sources.

28. The illuminated hand cover assembly of claim 10, wherein the second light emission area is adapted to emit light about the second axis of illumination toward a palmar surface of the thumb of the user when the hand cover is donned.

29. The illuminated hand cover assembly of claim 20, further comprising an energy source coupled to the hand cover, the energy source coupled in communication with the first light source and the second light source to provide energy to power the first and second light sources.

30. The illuminated hand cover assembly of claim 21, wherein the first light emission area is adapted to emit light about the first axis of illumination toward a palmar surface of the thumb of the user when the hand cover is donned, and wherein the second light emission area is adapted to emit light about the second axis of illumination toward a palmar surface of the index finger of the user when the hand cover is donned.

31. An illuminated hand cover assembly comprising:

(a) a hand cover including an index finger portion, the index finger portion adapted to cover at least a portion of a user's index finger when the hand cover is donned; and (b) a first light source having a first light emission area coupled to a lateral side of the index finger portion such that the first light emission area is disposed adjacent a lateral side of the middle phalanx bone of the index finger of the user when the hand cover is donned; and (c) a thumb portion adapted to cover at least a portion of the user's thumb when the hand cover is donned, and further including a second light source having a second light emission area coupled to the thumb portion such that the second light emission area is disposed adjacent a lateral side of a proximal phalanx bone of the thumb of the user when the hand cover is donned.

32. The illuminated hand cover assembly of claim 31, wherein the thumb portion includes an aperture at a distal end of the thumb portion to expose a distal end of the thumb of the user when the hand cover is donned by the user.

33. The illuminated hand cover assembly of claim 31, wherein the index finger portion includes an aperture at a distal end of the index finger portion to expose a distal end of the index finger of the user when the hand cover is donned by the user.

34. The illuminated hand cover assembly of claim 31, wherein the second light emission area is adapted to emit light about a second axis of illumination, the second axis of illumination inclined relative to a center axis of the proximal phalanx bone of the thumb by a second selected incline angle to direct the second axis of illumination toward a distal end of the thumb of the user when the hand cover is donned.

35. The illuminated hand cover assembly of claim 34, wherein the second light emission area is adapted to emit light about the second axis of illumination toward a palmar surface of the thumb of the user when the hand cover is donned.

36. The illuminated hand cover assembly of claim 34, wherein the second selected incline angle is greater than 0 degrees and less than about 45 degrees.

37. The illuminated hand cover assembly of claim 34, wherein the second selected incline angle is greater than about 5 degrees and less than about 30 degrees.

38. The illuminated hand cover assembly of claim 31, further comprising an energy source coupled to the hand cover, the energy source coupled in communication with the first light source to provide energy to the first light source.

39. The illuminated hand cover assembly of claim 31, further comprising an energy source coupled to the hand cover, the energy source coupled in communication with the first and second light sources to provide energy to the first and second light sources.

40. An illuminated hand cover assembly comprising:

(a) a hand cover including an index finger portion, the index finger portion adapted to cover at least a portion of a user's index finger when the hand cover is donned and including an aperture at a distal end of the index finger portion to expose a distal end of the index finger of the user when the hand cover is donned by the user; and (b) a first light source having a first light emission area coupled to a lateral side of the index finger portion such that the first light emission area is disposed adjacent a lateral side of the middle phalanx bone of the index finger of the user when the hand cover is donned.

41. The illuminated hand cover assembly of claim 40, wherein the first light emission area is adapted to emit light about a first axis of illumination, the first axis of illumination inclined relative to a center axis of the middle phalanx bone of the index finger by a first selected incline angle to direct the first axis of illumination toward a palmar surface of a fingertip of the index finger of the user when the hand cover is donned.

42. The illuminated hand cover assembly of claim 40, wherein the first light emission area is adapted to emit light about a first axis of illumination, the first axis of illumination inclined relative to a center axis of the middle phalanx bone of the index finger by a first selected incline angle to direct the first axis of illumination toward a distal end of the index finger of the user when the hand cover is donned.

43. The illuminated hand cover assembly of claim 42, wherein the first selected incline angle is greater than 0 degrees and less than about 45 degrees.

44. The illuminated hand cover assembly of claim 42, wherein the first selected incline angle is greater than about 5 degrees and less than about 30 degrees.

45. The illuminated hand cover assembly of claim 40, further comprising an energy source coupled to the hand cover, the energy source coupled in communication with the first light source to provide energy to the first light source.

46. The illuminated hand cover assembly of claim 40, wherein the hand cover further includes a thumb portion adapted to cover at least a portion of the user's thumb when the hand cover is donned, and further including a second light source having a second light emission area coupled to the thumb portion such that the second light emission area is disposed adjacent a lateral side of a proximal phalanx bone of the thumb of the user when the hand cover is donned.

47. The illuminated hand cover assembly of claim 46, wherein the thumb portion includes an aperture at a distal end of the thumb portion to expose a distal end of the thumb of the user when the hand cover is donned by the user.

48. The illuminated hand cover assembly of claim 46, wherein the second light emission area is adapted to emit light about a second axis of illumination, the second axis of illumination inclined relative to a center axis of the proximal phalanx bone of the thumb by a second selected incline angle to direct the second axis of illumination toward a distal end of the thumb of the user when the hand cover is donned.

49. The illuminated hand cover assembly of claim 48, wherein the second light emission area is adapted to emit light about the second axis of illumination toward a palmar surface of the thumb of the user when the hand cover is donned.

50. The illuminated hand cover assembly of claim 48, wherein the second selected incline angle is greater than 0 degrees and less than about 45 degrees.

51. The illuminated hand cover assembly of claim 48, wherein the second selected incline angle is greater than about 5 degrees and less than about 30 degrees.

52. The illuminated hand cover assembly of claim 46, further comprising an energy source coupled to the hand cover, the energy source coupled in communication with the first light source and the second light source to provide energy to the first and second light sources.

* * * * *